US008626510B2

(12) United States Patent
Mizutani

(10) Patent No.: US 8,626,510 B2
(45) Date of Patent: Jan. 7, 2014

(54) SPEECH SYNTHESIZING DEVICE, COMPUTER PROGRAM PRODUCT, AND METHOD

(75) Inventor: Nobuaki Mizutani, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1149 days.

(21) Appl. No.: 12/559,844

(22) Filed: Sep. 15, 2009

(65) Prior Publication Data

US 2010/0250254 A1 Sep. 30, 2010

(30) Foreign Application Priority Data

Mar. 25, 2009 (JP) ..... 2009-074849

(51) Int. Cl.
*G10L 13/00* (2006.01)

(52) U.S. Cl.
USPC ..... 704/260; 704/258

(58) Field of Classification Search
USPC ..... 704/258, 260
See application file for complete search history.

(56) References Cited

U.S. PATENT DOCUMENTS

| | | | | |
|---|---|---|---|---|
| 5,732,395 | A * | 3/1998 | Silverman | 704/260 |
| 8,015,011 | B2 * | 9/2011 | Nagano et al. | 704/260 |
| 2002/0120451 | A1 * | 8/2002 | Kato et al. | 704/258 |

FOREIGN PATENT DOCUMENTS

| | | |
|---|---|---|
| JP | 07-210194 | 8/1995 |
| JP | 07-253987 | 10/1995 |
| JP | 3060276 | 4/2000 |
| JP | 2007-212884 | 8/2007 |
| JP | 2008-225254 | 9/2008 |
| JP | 2009-037214 | 2/2009 |

OTHER PUBLICATIONS

Japanese Office Action for Japanese Application No. 2009-074849 mailed on Aug. 7, 2012.

* cited by examiner

*Primary Examiner* — Vincent P Harper
(74) *Attorney, Agent, or Firm* — Turocy & Watson, LLP

(57) ABSTRACT

An acquiring unit acquires pattern sentences, which are similar to one another and include fixed segments and non-fixed segments, and substitution words that are substituted for the non-fixed segments. A sentence generating unit generates target sentences by replacing the non-fixed segments with the substitution words for each of the pattern sentences. A first synthetic-sound generating unit generates a first synthetic sound, a synthetic sound of the fixed segment, and a second synthetic-sound generating unit generates a second synthetic sound, a synthetic sound of the substitution word, for each of the target sentences. A calculating unit calculates a discontinuity value of a boundary between the first synthetic sound and the second synthetic sound for each of the target sentences and a selecting unit selects the target sentence having the smallest discontinuity value. A connecting unit connects the first synthetic sound and the second synthetic sound of the target sentence selected.

9 Claims, 10 Drawing Sheets

FIG.2

101

| PATTERN SENTENCE |
|---|
| 今夜の[A]地方の天気は[B]でしょう。<br>Tonight's weather in the [A] area is [B]. |
| 今夜の[A]地方の天気は[B]の模様です。<br>Tonight's weather in the [A] area is going to be [B]. |
| 今夜の[A]地方の空模様は、[B]でしょう。<br>Tonight's weather condition in the [A] area is [B]. |
| 今夜の[A]の空模様は、[B]でしょう。<br>Tonight's weather condition in [A] is [B]. |
| [A]地方の今夜の天気は[B]でしょう。<br>In the [A] area, tonight's weather is [B]. |
| [A]地方の今夜の天気は[B]の模様です。<br>In the [A] area, tonight's weather is going to be [B]. |
| 今夜の天気です。[A]地方は[B]でしょう。<br>Tonight's weather. The [A] area is [B]. |
| 今夜の天気です。[A]地方は[B]の模様です。<br>Tonight's weather. The [A] area is going to be [B]. |
| 今夜の空模様です。[A]地方は[B]でしょう。<br>Tonight's weather condition. The [A] area is [B] |
| 今夜の[A]地方は、[B]でしょう。<br>Tonight, the [A] area is [B]. |

102 103 104

FIG.3

| | SUBSTITUTION CHARACTER STRING | |
|---|---|---|
| | A | 東京<br>Tokyo |
| | B | 晴れ<br>Fine |

111 112

FIG.4

111 112 121

102 103 104

| TARGET SENTENCE |
| --- |
| 今夜の[東京]地方の天気は[晴れ]でしょう。<br>Tonight's weather in the [Tokyo] area is [fine]. |
| 今夜の[東京]地方の天気は[晴れ]の模様です。<br>Tonight's weather in the [Tokyo] area is going to be [fine]. |
| 今夜の[東京]地方の空模様は、[晴れ]でしょう。<br>Tonight's weather condition in the [Tokyo] area is [fine]. |
| 今夜の[東京]の空模様は、[晴れ]でしょう。<br>Tonight's weather condition in [Tokyo] is [fine]. |
| [東京]地方の今夜の天気は[晴れ]でしょう。<br>In the [Tokyo] area, tonight's weather is [fine]. |
| [東京]地方の今夜の天気は[晴れ]の模様です。<br>In the [Tokyo] area, tonight's weather is going to be [fine]. |
| 今夜の天気です。[東京]地方は[晴れ]でしょう。<br>Tonight's weather. The [Tokyo] area is [fine]. |
| 今夜の天気です。[東京]地方は[晴れ]の模様です。<br>Tonight's weather. The [Tokyo] area is going to be [fine]. |
| 今夜の空模様です。[東京]地方は[晴れ]でしょう。<br>Tonight's weather condition. The [Tokyo] area is [fine] |
| 今夜の[東京]地方は、[晴れ]でしょう。<br>Tonight, the [Tokyo] area is [fine]. |

SPEECH SYNTHESIZING DEVICE, COMPUTER PROGRAM PRODUCT, AND METHOD

CROSS-REFERENCE TO RELATED APPLICATIONS

This application is based upon and claims the benefit of priority from the prior Japanese Patent Application No. 2009-074849, filed on Mar. 25, 2009; the entire contents of which are incorporated herein by reference.

BACKGROUND OF THE INVENTION

1. Field of the Invention

The present invention relates to a device, a computer program product, and a method for speech synthesis.

2. Description of the Related Art

Speech synthesizing devices have been applied to voice services for traffic information and weather reports, bank transfer inquiry services, and interfaces of humanlike machines such as robots. The speech synthesizing devices therefore need to offer synthetic speeches that sound clear and natural.

An example of such a technology conducts speech synthesis for a sentence containing fixed segments that are fixed information and non-fixed segments that are variable information (see JP-A H8-63187 (KOKAI), for example). Concerning the fixed segments, time-changing patterns of fundamental frequencies (hereinafter, referred to as "F0 patterns") are extracted and stored from speeches of the sentences produced by a human. Concerning the non-fixed segments, F0 patterns corresponding to all combinations of the number of syllables of words or phrases and stresses of the words or phrases, which are expected to be input, are stored. A synthetic speech that sounds natural as a sentence is generated by selecting or generating F0 patterns for each of fixed segments and non-fixed segments and then connecting the F0 patterns.

With conventional speech synthesizing devices, however, because a synthetic speech of only a single sentence is generated, unnaturalness accompanied by connecting synthetic sounds tends to be noticeable.

SUMMARY OF THE INVENTION

According to one aspect of the present invention, a speech synthesizing device includes an acquiring unit configured to acquire a plurality of pattern sentences, which are similar to one another and each include a fixed segment and a non-fixed segment, and a substitution word, the fixed segment is not to be replaced with any other word, the non-fixed segment is to be replaced with another word, the substitution word is substituted for the non-fixed segment; a sentence generating unit configured to generate a plurality of target sentences by replacing the non-fixed segment with the substitution word for each of the pattern sentences; a first synthetic-sound generating unit configured to generate a first synthetic sound, which is a synthetic sound of the fixed segment, for each of the target sentences; a second synthetic-sound generating unit configured to generate a second synthetic sound, which is a synthetic sound of the substitution word, for each of the target sentences; a calculating unit configured to calculate a discontinuity value of a boundary between the first synthetic sound and the second synthetic sound, for each of the target sentences; a selecting unit configured to select one of the target sentences having the smallest discontinuity value from the target sentences; and a connecting unit configured to connect the first synthetic sound and the second synthetic sound of the target sentence selected.

According to another aspect of the present invention, a speech synthesizing device includes an acquiring unit configured to acquire a pattern sentence, which includes a fixed segment that is not to be replaced with any other word and a non-fixed segment that is to be replaced with another word, and a substitution word that is substituted for the non-fixed segment; a first sentence generating unit configured to generate a target sentence by replacing the non-fixed segment with the substitution word; a second sentence generating unit configured to generate an alternative target sentence that has a higher similarity to the target sentence than a threshold; a first synthetic-sound generating unit configured to generate a first synthetic sound, which is a synthetic sound of the fixed segment, for the target sentence and the alternative target sentence; a second synthetic-sound generating unit configured to generate a second synthetic sound, which is a synthetic sound of the substitution word, for the target sentence and the alternative target sentence; a calculating unit configured to calculate a discontinuity value of a boundary between the first synthetic sound and the second synthetic sound, for the target sentence and the alternative target sentence; a selecting unit configured to select the target sentence or the alternative target sentence, whichever has the smaller discontinuity value; and a connecting unit configured to connect the first synthetic sound and the second synthetic sound of the target sentence or the alternative target sentence that is selected.

According to still another aspect of the present invention, a computer program product has a computer readable medium including programmed instructions for synthesizing a speech that, when executed by a computer, causes the computer to perform acquiring a plurality of pattern sentences, which are similar to one another and each include a fixed segment and a non-fixed segment, and a substitution word, the fixed segment is not to be replaced with any other word, the non-fixed segment is to be replaced with another word, the substitution word is substituted for the non-fixed segment; generating a plurality of target sentences by replacing the non-fixed segment with the substitution word for each of the pattern sentences; generating a first synthetic sound, which is a synthetic sound of the fixed segment, for each of the target sentences; generating a second synthetic sound, which is a synthetic sound of the substitution word, for each of the target sentences; calculating a discontinuity value of a boundary between the first synthetic sound and the second synthetic sound, for each of the target sentences; selecting one of the target sentences having the smallest discontinuity value from the target sentences; and connecting the first synthetic sound and the second synthetic sound of the target sentence selected.

According to still another aspect of the present invention, a computer program product has a computer readable medium including programmed instructions for synthesizing a speech that, when executed by a computer, causes the computer to perform acquiring a pattern sentence, which includes a fixed segment that is not to be replaced with any other word and a non-fixed segment that is to be replaced with another word, and a substitution word that is to be substituted for the non-fixed segment; generating a target sentence by replacing the non-fixed segment with the substitution word; generating an alternative target sentence having a higher similarity to the target sentence than a threshold; generating a first synthetic sound, which is a synthetic sound of the fixed segment, for the target sentence and the alternative target sentence; generating a second synthetic sound, which is a synthetic sound of the substitution word, for the target sentence and the alternative target sentence; calculating a discontinuity value of a boundary between the first synthetic sound and the second synthetic sound, for the target sentence and the alternative target sentence; selecting the target sentence or the alternative target sentence, whichever has the smaller discontinuity value; and connecting the first synthetic sound and the second synthetic sound of the target sentence or the alternative target sentence that is selected.

According to still another aspect of the present invention, a speech synthesizing method includes acquiring a plurality of pattern sentences, which are similar to one another and each include a fixed segment and a non-fixed segment, and a substitution word, the fixed segment is not to be replaced with any other word, the non-fixed segment is to be replaced with another word, the substitution word is substituted for the non-fixed segment; generating a plurality of target sentences by replacing the non-fixed segment with the substitution word for each of the pattern sentences; generating a first synthetic sound, which is a synthetic sound of the fixed segment, for each of the target sentences; generating a second synthetic sound, which is a synthetic sound of the substitution word, for each of the target sentences; calculating a discontinuity value of a boundary between the first synthetic sound and the second synthetic sound, for each of the target sentences; selecting one of the target sentences having the smallest discontinuity value from the target sentences; and connecting the first synthetic sound and the second synthetic sound of the target sentence selected.

According to still another aspect of the present invention, a speech synthesizing method includes acquiring a pattern sentence, which includes a fixed segment that is not to be replaced with any other word and a non-fixed segment that is to be replaced with another word, and a substitution word that is to be substituted for the non-fixed segment; generating a target sentence by replacing the non-fixed segment with the substitution word; generating an alternative target sentence having a higher similarity to the target sentence than a threshold; generating a first synthetic sound, which is a synthetic sound of the fixed segment, for the target sentence and the alternative target sentence; generating a second synthetic sound, which is a synthetic sound of the substitution word, for the target sentence and the alternative target sentence; calculating a discontinuity value of a boundary between the first synthetic sound and the second synthetic sound, for the target sentence and the alternative target sentence; selecting the target sentence or the alternative target sentence, whichever has the smaller discontinuity value; and connecting the first synthetic sound and the second synthetic sound of the target sentence or the alternative target sentence that is selected.

BRIEF DESCRIPTION OF THE DRAWINGS

FIG. 2 is a diagram showing examples of pattern sentences acquired by an acquiring unit according to the first embodiment;

FIG. 3 is a diagram showing examples of substitution words acquired by the acquiring unit according to the first embodiment;

FIG. 4 is a diagram showing examples of target sentences generated by a sentence generating unit according to the first embodiment;

DETAILED DESCRIPTION OF THE INVENTION

Exemplary embodiments of a speech synthesizing device, a computer program product, and a method according to the present invention are described in detail below with reference to the accompanying drawings.

In a first embodiment, a plurality of target sentences are generated by replacing non-fixed segments of pattern sentences that are similar to one another with substitution words; one of the target sentences that has the smallest discontinuity value for the boundary between a fixed synthetic sound and rule-based synthetic sound is selected from the generated target sentences; and a synthetic speech is output by connecting the fixed synthetic sounds and the rule-based synthetic sounds of the selected target sentence. Pattern sentences are similar to one another and include fixed segments that are not to be replaced with any other word and non-fixed segments that are to be replaced with different words.

First, the configuration of a speech synthesizing device according to the first embodiment is described.

Figure 1:
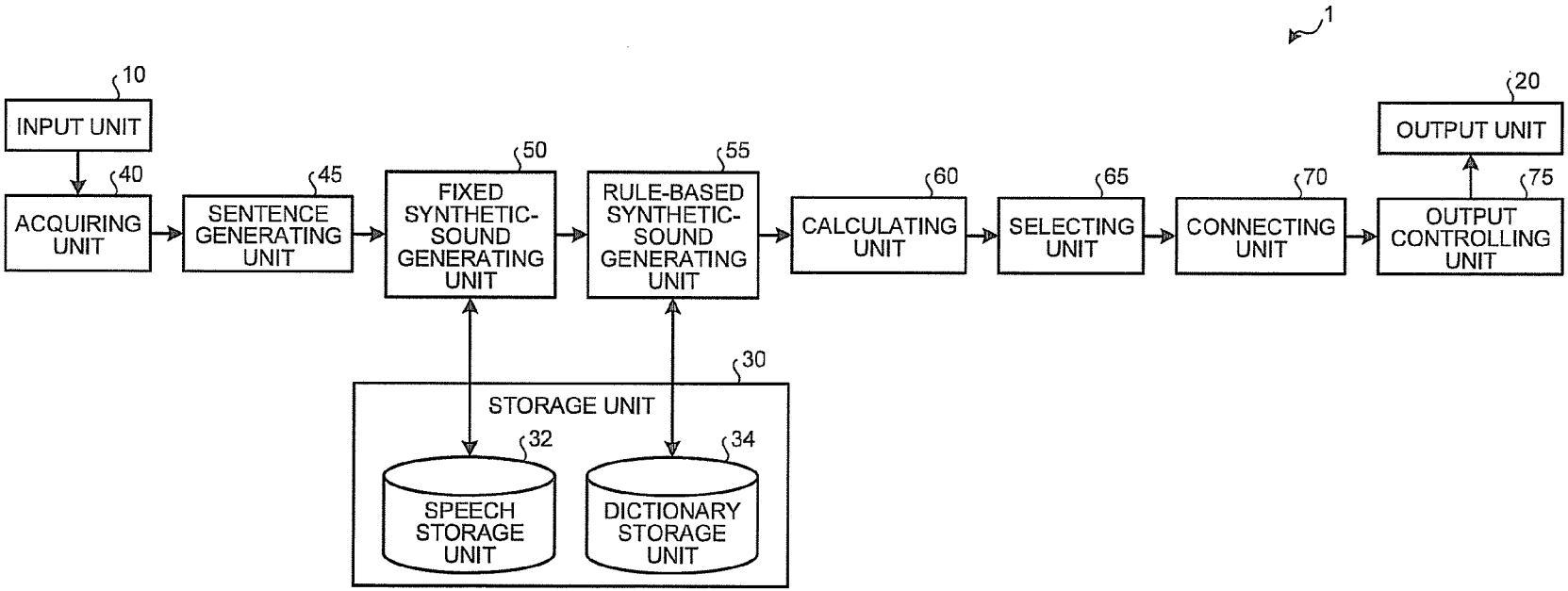
FIG. 1 is a block diagram showing an example configuration of a speech synthesizing device according to a first embodiment.

As illustrated in FIG. 1, the speech synthesizing device 1 includes an input unit 10, an output unit 20, a storage unit 30, an acquiring unit 40, a sentence generating unit 45, a fixed synthetic-sound generating unit 50, a rule-based synthetic-sound generating unit 55, a calculating unit 60, a selecting unit 65, a connecting unit 70, and an output controlling unit 75.

The input unit 10 is configured to input a sentence or word for speech synthesis. A conventional input device such as a keyboard, a mouse, and a touch panel may be used.

The output unit 20 outputs speech synthesis results in response to an instruction from the later-described output controlling unit 75. A conventional speech output device such as a speaker may be used.

The storage unit 30 stores information that is used for various processes executed by the speech synthesizing device 1. The storage unit 30 may be a conventional recording medium in which information is magnetically, electrically, or optically stored, such as a hard disk drive (HDD), a solid state drive (SSD), a memory card, an optical disk, and a random access memory (RAM). The storage unit 30 includes a speech storage unit 32 and a dictionary storage unit 34. The speech storage unit 32 and the dictionary storage unit 34 are described in detail later.

The acquiring unit 40 acquires a plurality of pattern sentences that are similar to one another and include fixed segments that are not to be replaced with any other word and non-fixed segments that are to be replaced with different words. The acquiring unit 40 also acquires substitution words with which the non-fixed segments are replaced. More specifically, the acquiring unit 40 acquires the similar pattern sentences and the substitution words that are input by the input unit 10. If a non-fixed segment included in each of the pattern sentences is singular, a substitution word acquired by the acquiring unit 40 is also singular. The "similar" sentences mean that they are semantically equivalent to one another. The similar sentences may be determined to be similar by a user, or sentences that have degrees of similarity that exceed a threshold may be selected. A "word" can be a single character or a single word, or a combination thereof.

As schematically illustrated in FIG. 2, pattern sentences may be Japanese sentences that are intended to report the evening weather and are semantically equivalent to one another. In each of the pattern sentences, it is assumed that the name of a specific area (e.g., Tokyo, Kanagawa, or Chiba) is inserted in A, while a specific condition of weather (e.g., fine, cloudy, or rainy) is inserted in B.

In the first embodiment, portions sandwiched by bracket signs '[' and ']' in each of the pattern sentences are non-fixed segments, and other portions are fixed segments. For example, in a pattern sentence 101 in FIG. 2, words 102, 103, and 104 are fixed segments, and segments A and B are non-fixed segments.

Substitution words 111 and 112 shown in FIG. 3 substitute for the non-fixed segments A and B in the group of pattern sentences indicated in FIG. 2.

In FIG. 1, the sentence generating unit 45 replaces, in each of the pattern sentences acquired by the acquiring unit 40, the non-fixed segments with the substitution words acquired by the acquiring unit 40 to generate a plurality of target sentences.

The target sentences shown in FIG. 4 are generated by substituting the substitution words 111 and 112 for the non-fixed segments A and B of each of the pattern sentences in FIG. 2. For example, a target sentence 121 in FIG. 4 is generated by substituting the substitution words 111 and 112 for the non-fixed segments A and B, respectively, of the pattern sentence 101 in FIG. 2.

In FIG. 1, the speech storage unit 32 stores speech data that is to be used by the later-described fixed synthetic-sound generating unit 50 for speech synthesis. The "speech data" represents waveforms of prerecorded speeches, speech parameters obtained by converting such speeches, or the like. The "speech parameters" are speeches expressed numerically by use of speech generation models to compress the data volume. Examples of speech generation models include formants, PARCOR, LSP, LPC, and cepstrum. The speech parameters are stored for each phonogram, or in smaller units depending on environments such as preceding/following phonograms or the like.

The fixed synthetic-sound generating unit 50 generates a fixed synthetic sound, which is a synthetic sound for a fixed segment, for each of the target sentences generated by the sentence generating unit 45. More specifically, the fixed synthetic-sound generating unit 50 uses the speech data stored in the speech storage unit 32, and then generates a fixed synthetic sound for each of the target sentences generated by the sentence generating unit 45.

When generating the fixed synthetic sound, a recording and editing method, in which a prerecorded speech is reproduced, or an analysis and synthesis method, in which a speech is synthesized from speech parameters that are obtained by converting a prerecorded speech, may be adopted. Examples of the analysis and synthesis method include formant synthesis, PARCOR synthesis, LSP synthesis, LPC synthesis, cepstrum synthesis, and waveform editing with which waveforms are directly edited. In the analysis and synthesis method, a speech parameter string of a fixed segment is generated from phonograms or the like, and a fixed synthetic sound is generated from the duration, F0 pattern, and speech parameter string of the fixed segment.

The dictionary storage unit 34 stores dictionary data and speech parameter strings extracted from natural speeches, which are to be used for the speech synthesis by the later-described rule-based synthetic-sound generating unit 55. The "dictionary data" includes data for linguistic analysis, such as morphological analysis and syntactic analysis of words, and data for accent and intonation processing. The dictionary storage unit 34 may also store model parameters that are obtained by approximating the speech parameter strings using models.

The rule-based synthetic-sound generating unit 55 generates a rule-based synthetic sound, which is a synthetic sound of a substitution word, for each of the target sentences generated by the sentence generating unit 45. More specifically, the rule-based synthetic-sound generating unit 55 generates the rule-based synthetic sound for each of the target sentences generated by the sentence generating unit 45 by referring to the dictionary data stored in the dictionary storage unit 34.

When generating the rule-based synthetic sound, a rule-based sound synthesis method may be adopted, with which a speech is generated from words by using rules such as dictionary data or the like. As a rule-based sound synthesis method, a method of reading speech parameter strings extracted from a natural speech, a method of converting model parameters to time-series speech parameter strings, or a method of generating model parameters regularly from the word analysis results and converting the model parameters to time-series speech parameter strings may be adopted.

The calculating unit 60 calculates a discontinuity value of the boundary between a fixed synthetic sound generated by the fixed synthetic-sound generating unit 50 and a rule-based synthetic sound generated by the rule-based synthetic-sound generating unit 55 for each of the target sentences generated by the sentence generating unit 45.

Figure 5:
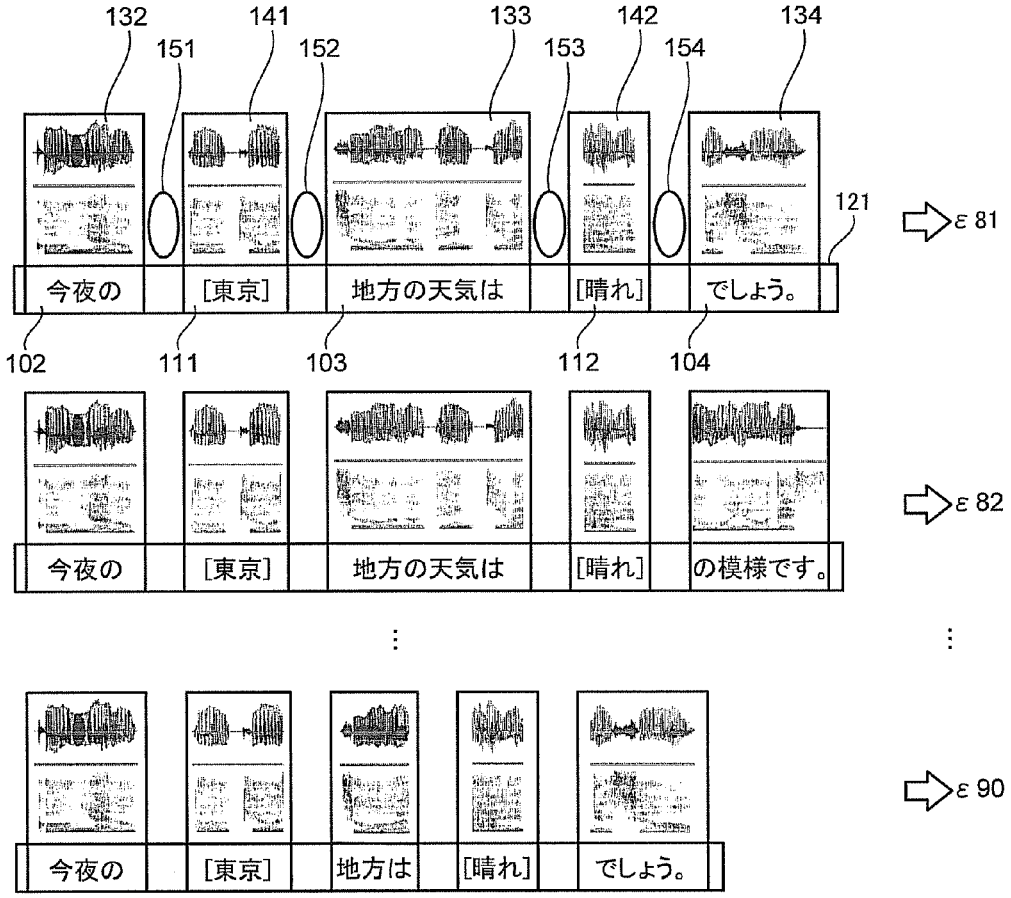
FIG. 5 is a diagram explaining an example method of calculating a discontinuity value adopted by a calculating unit according to the first embodiment.

FIG. 5 shows speech waveforms that indicate synthetic sounds generated for some of the target sentences in FIG. 4. The calculating unit 60 calculates the discontinuity value of the connection boundary of the speech waveforms as a distortion value $\epsilon$ for each target sentence.

For example, speech waveforms 132, 133, and 134 in FIG. 5 indicate the fixed synthetic sounds of the words 102, 103, and 104, respectively, which are the fixed segments of the target sentence 121. Speech waveforms 141 and 142 indicate the rule-based synthetic-sound of the substitution words 111 and 112, respectively, of the target sentence 121. In the example of FIG. 5, five synthetic sounds are generated for the target sentence 121, which form four connection boundaries 151 to 154 in the target sentence 121. Then, the calculating unit 60 calculates the discontinuity value of the connection boundaries 151 to 154 of the target sentence 121 as a distortion value ϵ81.

When a target sentence includes more than one connection boundaries as in the target sentence 121 in FIG. 5, a value having the highest degree of discontinuity among the discontinuity values of the connection boundaries may be determined as the distortion value ϵ, or the sum or average of the discontinuity values of the connection boundaries may be determined as the distortion value ϵ.

In FIG. 1, the selecting unit 65 selects one of the target sentences having the smallest discontinuity value that is calculated by the calculating unit 60 from the target sentences generated by the sentence generating unit 45. In particular, the selecting unit 65 identifies ϵ_best, which is the smallest discontinuity value among the discontinuity values of the target sentences using expression (1) and selects the target sentence having this ϵ_best.

$$\epsilon_best = \arg\min \epsilon_n \quad (1)$$

In the expression (1), "ϵ_n" denotes the distortion value of each target sentence. In the example of FIG. 5, ϵ_n={ϵ81 . . . ϵ90}. In other words, the expression (1) finds the smallest ϵ from ϵ_n.

In the example of FIG. 5, it is assumed that ϵ_best=ϵ81, and that the selecting unit 65 selects the target sentence 121 from the target sentences in FIG. 5.

The connecting unit 70 connects the fixed synthetic sounds and the rule-based synthetic sounds in the target sentence selected by the selecting unit 65. The connecting unit 70 may execute post-processing such as smoothing so that the connection boundaries of the synthetic sounds can be smoothly connected.

Figure 6:
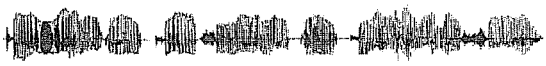
FIG. 6 is a diagram showing an example of a synthetic speech generated from synthetic sounds that are connected by a connecting unit according to the first embodiment.

In the example of FIG. 5, the selecting unit 65 selects the target sentence 121, and therefore the connecting unit 70 connects the speech waveforms 132, 141, 133, 142, and 134 to generate the synthetic speech of the target sentence 121, as illustrated in FIG. 6.

The output controlling unit 75 outputs the speech that is generated by the connecting operation of the connecting unit 70, through the output unit 20. More specifically, the output controlling unit 75 performs a digital-to-analog conversion on the synthetic speech generated by the connecting operation of the connecting unit 70 in order to obtain an analog signal and output the speech through the output unit 20.

The acquiring unit 40, the sentence generating unit 45, the fixed synthetic-sound generating unit 50, the rule-based synthetic-sound generating unit 55, the calculating unit 60, the selecting unit 65, the connecting unit 70, and the output controlling unit 75 may be implemented by conventional controlling devices, which include components such as a central processing unit (CPU) and an application specific integrated circuit (ASIC).

The operation of the speech synthesizing device according to the first embodiment is now explained.

Figure 7:
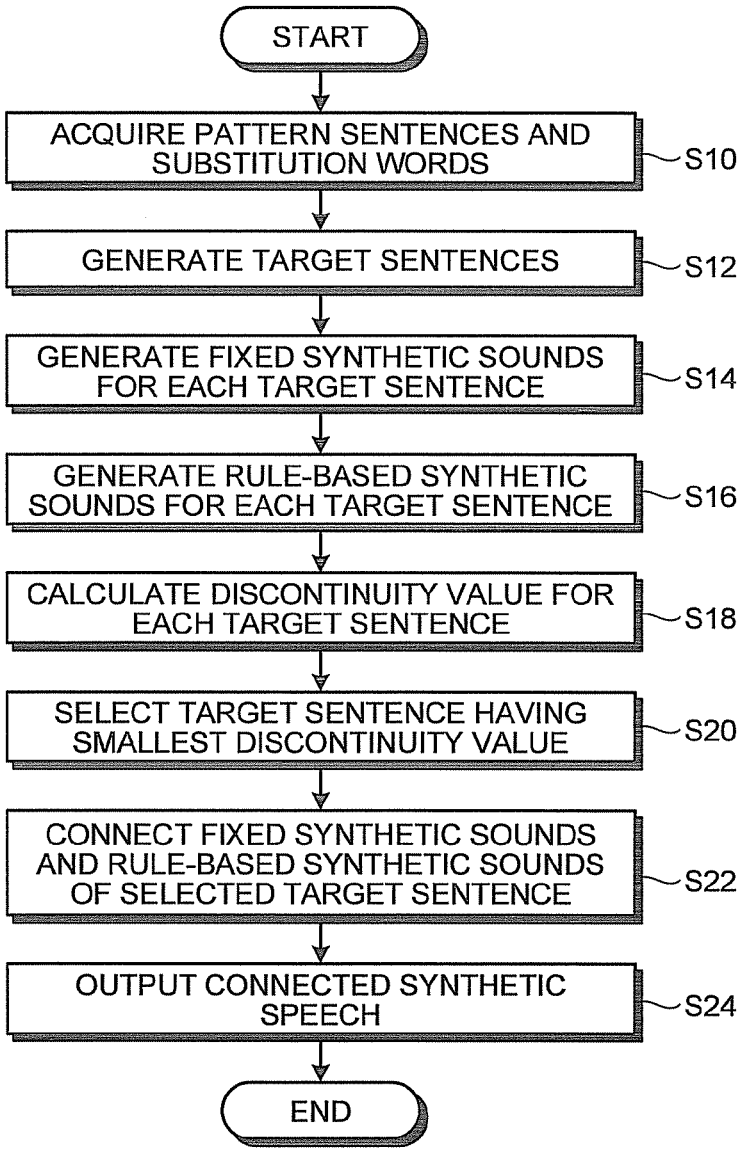
FIG. 7 is a flowchart showing an example procedure of a speech synthesizing process performed by the speech synthesizing device according to the first embodiment.

At Step S10 shown in FIG. 7, the acquiring unit 40 acquires the pattern sentences and the substitution words that are input by the input unit 10.

At Step S12, the sentence generating unit 45 generates target sentences by substituting the substitution words acquired by the acquiring unit 40 for the non-fixed segments of the pattern sentences acquired by the acquiring unit 40.

At Step S14, the fixed synthetic-sound generating unit 50 generates fixed synthetic sounds for the target sentences generated by the sentence generating unit 45 by using the speech data stored in the speech storage unit 32.

At Step S16, the rule-based synthetic-sound generating unit 55 generates rule-based synthetic sounds for the target sentences generated by the sentence generating unit 45, by referring the dictionary data stored in the dictionary storage unit 34.

At Step S18, the calculating unit 60 calculates a discontinuity value of the boundary between the fixed synthetic sounds generated by the fixed synthetic-sound generating unit 50 and the rule-based synthetic sounds generated by the rule-based synthetic-sound generating unit 55, for the target sentences generated by the sentence generating unit 45.

At Step S20, the selecting unit 65 selects one of the target sentences having the smallest discontinuity value calculated by the calculating unit 60, from the target sentences generated by the sentence generating unit 45.

At Step S22, the connecting unit 70 connects the fixed synthetic sounds and the rule-based synthetic sounds of the target sentence selected by the selecting unit 65.

At Step S24, the output controlling unit 75 outputs the synthetic speech connected by the connecting unit 70 through the output unit 20.

As described above, according to the first embodiment, a plurality of target sentences are generated by substituting substitution words for non-fixed segments of pattern sentences that are semantically equivalent to one another; one of the target sentences having the smallest discontinuity value for the connection boundary between the fixed synthetic sounds and the rule-based synthetic sounds is selected from the target sentences; and a synthetic speech is generated and output by connecting the fixed synthetic sounds and the rule-based synthetic sounds of the selected target sentence.

According to the first embodiment, because the synthetic speech of the target sentence having the smallest discontinuity value is selected for output from a plurality of the target sentences that are semantically equal to one another, the synthetic speech can be generated with less unnaturalness, which is accompanied by connecting synthetic sounds.

Next, a second embodiment will be described in which a target sentence and an alternative target sentence that is semantically equivalent to the target sentence are generated from a single pattern sentence; a sentence having a smaller discontinuity value for the connection boundary between the fixed synthetic sounds and the rule-based synthetic sounds is selected from the generated target sentence and the alternative target sentence; the fixed synthetic sounds and the rule-based synthetic sounds of the selected sentence are connected into a synthetic speech; and the synthetic speech is output.

The following explanation mainly focuses on differences between the first and second embodiments. Components that have similar functions to those of the first embodiment are given the same names and numerals, and the explanation thereof is omitted.

First, the configuration of a speech synthesizing device according to the second embodiment is described.

Figure 8:
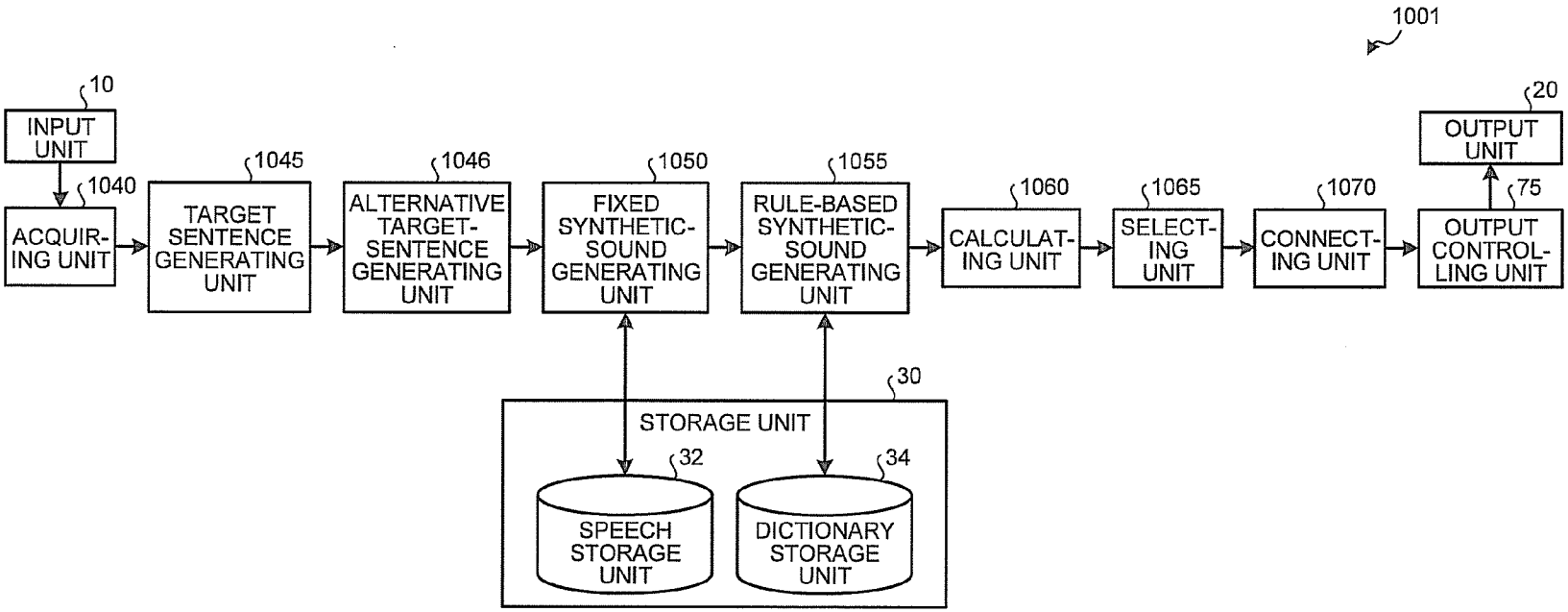
FIG. 8 is a block diagram showing an example configuration of a speech synthesizing device according to a second embodiment.

The speech synthesizing device 1001 shown in FIG. 8 is differentiated from the speech synthesizing device 1 according to the first embodiment in that an acquiring unit 1040 acquires a single pattern sentence.

In addition, the speech synthesizing device 1001 is differentiated from the speech synthesizing device 1 in that a target-sentence generating unit 1045 and an alternative target-sentence generating unit 1046 are included in place of the sentence generating unit 45.

Furthermore, the speech synthesizing device 1001 is differentiated from the speech synthesizing device 1 in that a fixed synthetic-sound generating unit 1050 generates fixed synthetic sounds, a rule-based synthetic-sound generating unit 1055 generates rule-based synthetic sounds, and a calculating unit 1060 calculates discontinuity values, for each of the target sentence and the alternative target sentence.

Still further, the speech synthesizing device 1001 is differentiated from the speech synthesizing device 1 in that a selecting unit 1065 selects the target sentence or the alternative target sentence whichever has the smallest discontinuity value, and a connecting unit 1070 connects the synthetic sounds of the target sentence or alternative target sentence whichever is selected.

In the following description, the target-sentence generating unit 1045 and the alternative target-sentence generating unit 1046, which are the main differences between the first and second embodiments, are explained.

The target-sentence generating unit 1045 substitutes substitution words acquired by the acquiring unit 1040 for the non-fixed segments of a pattern sentence acquired by the acquiring unit 1040, and generates a target sentence. The target-sentence generating unit 1045 generates a single target sentence. Other functions are the same as those of the sentence generating unit 45 according to the first embodiment, and therefore the detailed explanation is omitted.

The alternative target-sentence generating unit 1046 generates an alternative target sentence that has a degree of similarity to the target sentence generated by the target-sentence generating unit 1045 higher than a threshold. More specifically, the alternative target-sentence generating unit 1046 generates the alternative target sentence by changing the word order of the pattern sentence, replacing some words of the pattern sentence with their synonyms, and/or replacing some phrases of the pattern sentence with other phrases, and also by substituting the substitution words for the non-fixed segments.

The alternative target-sentence generating unit 1046 calculates the degree of similarity by using an edit distance that indicates how similar the alternative target sentence is to the target sentence, and generates the alternative target sentence of which the degree of similarity exceeds the threshold. More specifically, the alternative target-sentence generating unit 1046 calculates the degree of similarity between the target sentence and the alternative target sentence in accordance with expression (2).

$$\phi=1/(\gamma+1) \tag{2}$$

In the expression (2), the similarity $\phi$ takes on values from 0 to 1, where it represents that the sentences have more similar (equivalent) meanings to each other as the value is closer to 1. The edit distance $\gamma$ represents how many times the following operations should be repeated to generate the alternative target sentence from the target sentence. The operations are (1) inserting a word into a specific position of the target sentence; (2) deleting a word from a specific position of the target sentence; and (3) changing the order of words at a specific position of the target sentence.

The method of generating an alternative target sentence is discussed below with a specific example in which the threshold of the similarity is set to 0.3.

Figure 9:
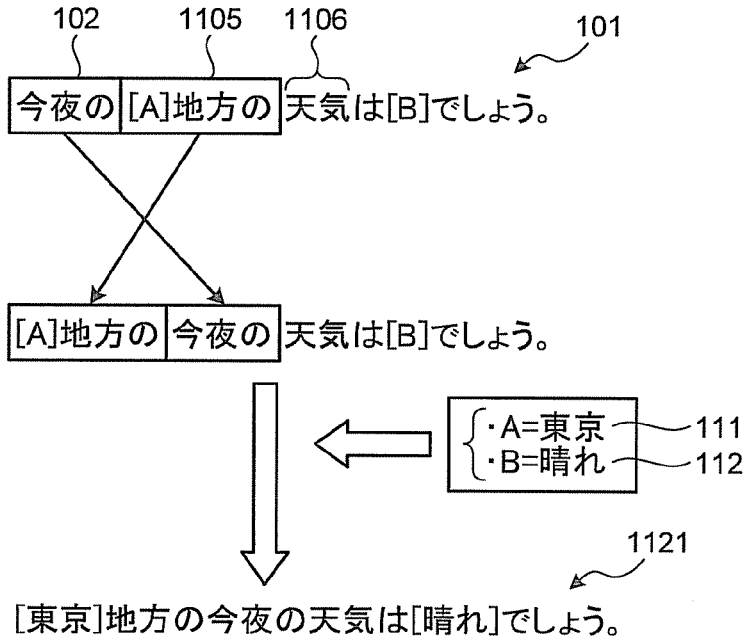
FIG. 9 is a diagram explaining an example of an alternative target sentence generated by an alternative target-sentence generating unit according to the second embodiment by changing the word order.

In an example shown in FIG. 9, the alternative target-sentence generating unit 1046 performs natural language processing such as language analysis and syntactic analysis onto the pattern sentence 101, and determines that words 102 and 1105 modify a word 1106 and that the words 102 and 1105 are interchangeable.

Furthermore, the alternative target-sentence generating unit 1046 determines that a sentence 1121 can be generated from a target sentence that is generated by replacing the non-fixed segments A and B of the pattern sentence 101 with the substitution words 111 and 112. Specifically, the alternative target-sentence generating unit 1046 determines that the sentence 1121 can be generated by changing the order of the words 102 and 1105 in the target sentence. The sentence 1121 is a Japanese sentence that means "tonight's weather in the Tokyo area is fine".

The edit distance $\gamma=1$ and the similarity $\phi=0.5$ are established between the sentence 1121 and the target sentence generated from the pattern sentence 101. Because the similarity exceeds the threshold, the alternative target-sentence generating unit 1046 generates the sentence 1121 as an alternative target sentence.

Figure 10:
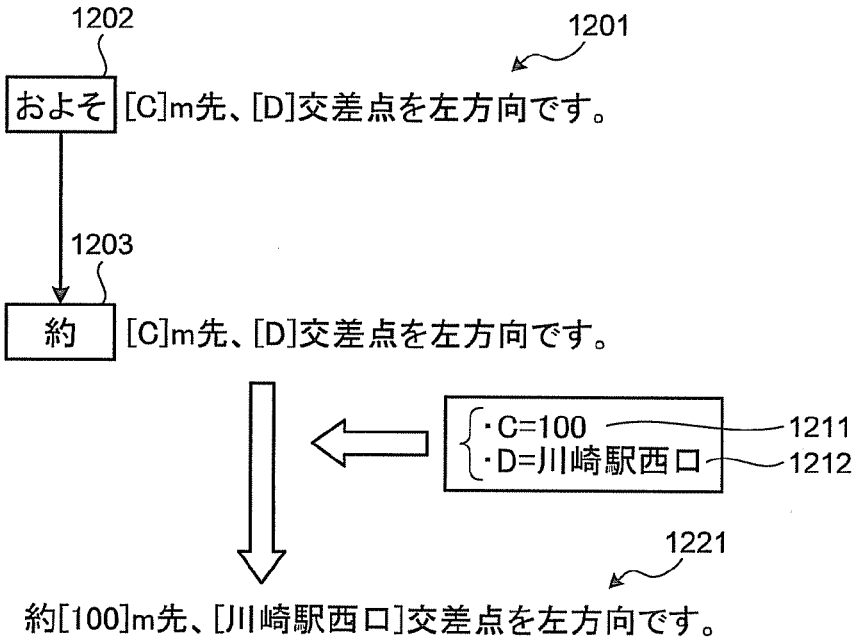
FIG. 10 is a diagram explaining an example of an alternative target sentence generated by the alternative target-sentence generating unit according to the second embodiment by replacing a word with its synonym.

In another example shown in FIG. 10, a pattern sentence 1201 is a Japanese sentence that indicates an approximate distance to a certain intersection and an instruction of turning left at the intersection. Substitution words 1211 and 1212 are to substitute for non-fixed segments C and D, respectively, of the pattern sentence 1201. The substitution word 1211 is a numeral 100, indicating the distance. The substitution word 1212 is Japanese words indicating the name of the intersection "Kawasaki Station West Exit".

In the example of FIG. 10, the alternative target-sentence generating unit 1046 refers to a synonym list (not shown) that defines synonyms, and then determines that a word 1202 of the pattern sentence 1201 can be replaced with a synonym 1203. The word 1202 and the synonym 1203 are Japanese words both meaning "approximately". The synonym list is stored in the storage unit 30 or the like in advance so that the alternative target-sentence generating unit 1046 can refer to the list.

Furthermore, the alternative target-sentence generating unit 1046 determines that a sentence 1221 can be generated from a target sentence that is generated by replacing the non-fixed segments C and D of the pattern sentence 1201 with the substitution words 1211 and 1212. Specifically, the alternative target-sentence generating unit 1046 determines that the sentence 1221 can be generated by replacing the word 1202 in the target sentence with the synonym 1203. The sentence 1221 is a Japanese sentence that tells the user to turn left at the Kawasaki-Station-West-Exit intersection about 100 meters ahead.

The edit distance $\gamma=1$ and the similarity $\phi=0.5$ are established between the sentence 1221 and the target sentence generated from the pattern sentence 1201. Because the similarity exceeds the threshold, the alternative target-sentence generating unit 1046 generates the sentence 1221 as an alternative target sentence.

Figure 11:
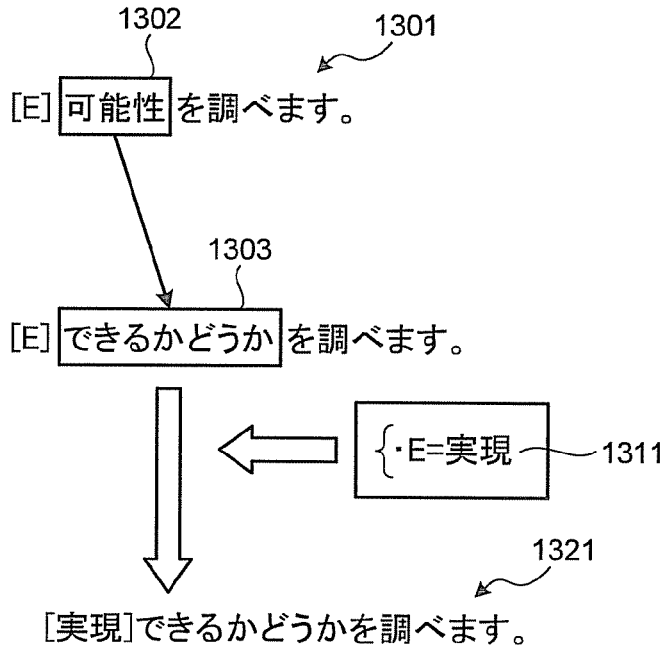
FIG. 11 is a diagram explaining an example of an alternative target sentence generated by the alternative target-sentence generating unit according to the second embodiment by replacing a phrase with an alternative phrase.

In still another example shown in FIG. 11, a pattern sentence 1301 is a Japanese sentence indicating that a possibility will be checked. A substitution word 1311 is a Japanese word for "realization", which is to be substituted for a non-fixed segment E of the pattern sentence 1301.

In the example of FIG. 11, the alternative target-sentence generating unit 1046 determines that a phrase 1302 of the pattern sentence 1301 can be replaced with a phrase 1303, by referring to a thesaurus or a phrasal thesaurus. The phrases 1302 and 1303 are Japanese phrases both indicating "possibility". The thesaurus or the like is stored in advance in the storage unit 30 so that the alternative target-sentence generating unit 1046 can refer to the thesaurus.

Furthermore, the alternative target-sentence generating unit 1046 determines that a sentence 1321 can be generated from a target sentence that is generated by replacing the non-fixed segment E of the pattern sentence 1301 with the substitution word 1311. Specifically, the alternative target-sentence generating unit 1046 determines that the sentence 1321 can be generated by replacing the phrase 1302 in the target sentence with the phrase 1303. The sentence 1321 is a Japanese sentence, meaning "the realization possibility will be checked".

The edit distance $\gamma=1$, and the similarity $\phi=0.5$ are established between the sentence 1321 and the target sentence generated from the pattern sentence 1301. Because the similarity exceeds the threshold, the alternative target-sentence generating unit 1046 generates the sentence 1321 as an alternative target sentence.

Figure 12:
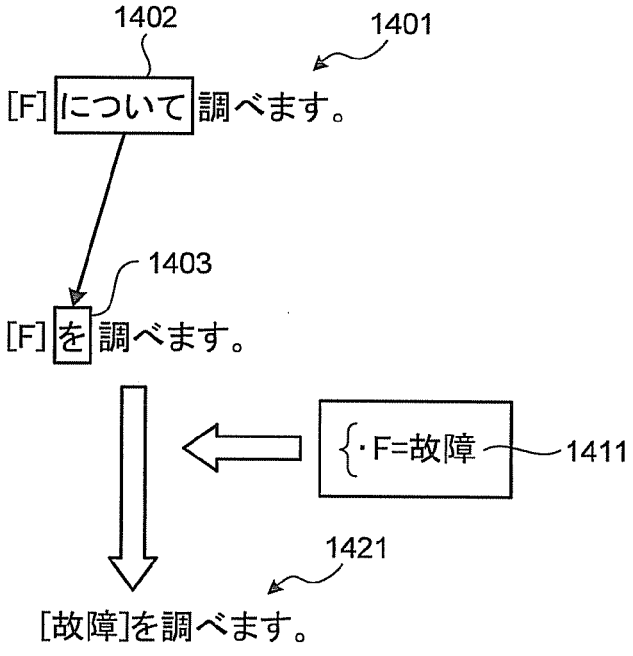
FIG. 12 is a diagram explaining another example of an alternative target sentence generated by the alternative target-sentence generating unit according to the second embodiment by replacing a phrase with an alternative phrase.

In still another example shown in FIG. 12, a pattern sentence 1401 is a Japanese sentence indicating that something "will be checked". A substitution word 1411 is a Japanese word for "breakdown", and is to be substituted for a non-fixed segment F of the pattern sentence 1401.

In the example of FIG. 12, the alternative target-sentence generating unit 1046 determines that a phrase 1402 in the pattern sentence 1401 can be replaced with a phrase 1403, by referring to the thesaurus or phrasal thesaurus. The phrase 1402 and the phrase 1403 are Japanese phrases both showing the object of the sentence, and both followed by a verb.

Furthermore, the alternative target-sentence generating unit 1046 determines that a sentence 1421 can be generated from a target sentence that is generated by replacing the non-fixed segment F of the pattern sentence 1401 with the substitution word 1411. Specifically, the alternative target-sentence generating unit 1046 determines that the sentence 1421 can be generated by replacing the phrase 1402 in the target sentence with the phrase 1403. The sentence 1421 is a Japanese sentence meaning "the breakdown will be checked".

The edit distance $\gamma=1$ and the similarity $\phi=0.5$ are established between the sentence 1421 and the target sentence generated from the pattern sentence 1401. Because the similarity exceeds the threshold, the alternative target-sentence generating unit 1046 generates the sentence 1421 as an alternative target sentence.

Figure 13:
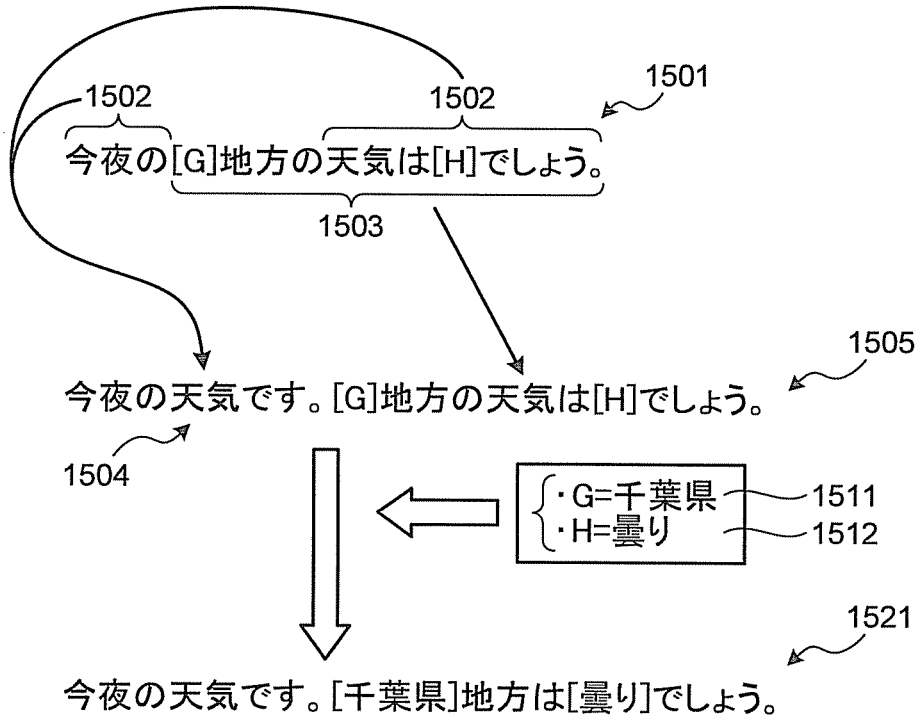
FIG. 13 is a diagram explaining another example of an alternative target sentence generated by the alternative target-sentence generating unit according to the second embodiment by replacing phrases with alternative phrases.

In still another example shown in FIG. 13, a pattern sentence 1501 is a Japanese sentence reporting the weather information of the evening in a certain region. Substitution words 1511 and 1512 are to be substituted for non-fixed segments G and H, respectively, of the pattern sentence 1501. The substitution word 1511 is a Japanese word for a Japanese prefecture "Chiba", while the substitution word 1512 is a Japanese word for "cloudy".

In the example of FIG. 13, the alternative target-sentence generating unit 1046 determines, by using the thesaurus or the phrasal thesaurus, that phrases 1502 and 1503 of the pattern sentence 1501 can be replaced with phrases 1504 and 1505, respectively. The phrases 1502 and 1504 are Japanese phrases indicating "tonight's weather", while the phrases 1503 and 1505 are Japanese phrases indicating the weather information of a certain region.

Furthermore, the alternative target-sentence generating unit 1046 determines that a sentence 1521 can be generated from a target sentence that is generated by replacing the non-fixed segments G and H of the pattern sentence 1501 with the substitution words 1511 and 1512, respectively. Specifically, the alternative target-sentence generating unit 1046 determines that the sentence 1521 can be generated by replacing the phrases in the target sentence with the phrases 1504 and 1505. The sentence 1521 is a Japanese sentence meaning "tonight's weather in the Chiba area is cloudy".

The edit distance $\gamma=1$ and the similarity $\phi=0.5$ are established between the sentence 1521 and the target sentence generated from the pattern sentence 1501. Because the similarity exceeds the threshold, the alternative target-sentence generating unit 1046 generates the sentence 1521 as an alternative target sentence.

In the second embodiment, the degree of similarity is calculated by use of the edit distance. Because words and phrases are hierarchically classified in a thesaurus and a phrasal thesaurus, the degree of similarity can be calculated based on this hierarchical structure. If this is the case, the alternative target-sentence generating unit 1046 calculates the degree of similarity between the target sentence and the alternative target sentence using expression (3).

$$\xi=2*Lc/(La+Lb) \tag{3}$$

In the expression (3), "Lc" represents the depth of a common upper level in the hierarchical structure, "La" represents a word in a target sentence, and "Lb" represents a word in an alternative target sentence that corresponds to the word of the target sentence. The level similarity takes on values between 0 and 1, where the value closer to 1 indicates that the relationship of the words is closer to the same linguistic information.

In addition to the above method, other conventional methods may be adopted for the generation of an alternative target sentence, such as a method disclosed by Kentaro Inui and Atsushi Fujita, "A Survey on Paraphrase Generation and Recognition", Journal of Natural Language Processing, Vol. 11, No. 5, pp. 151-198, 2004, 10.

The processes performed by the fixed synthetic-sound generating unit 1050, the rule-based synthetic-sound generating unit 1055, and the calculating unit 1060 are the same as the processes performed by the fixed synthetic-sound generating unit 50, the rule-based synthetic-sound generating unit 55, and the calculating unit 60 according to the first embodiment, except that the processes are performed on each of the target sentence and the alternative target sentence. Thus, the detailed explanation thereof is omitted.

Similarly, the processes performed by the selecting unit 1065 and the connecting unit 1070 are the same as the processes performed by the selecting unit 65 and the connecting unit 70 according to the first embodiment except that the processes are performed on each of the target sentence and the alternative target sentence, and therefore the detailed explanation thereof is omitted.

The operation of the speech synthesizing device according to the second embodiment is described below.

Figure 14:
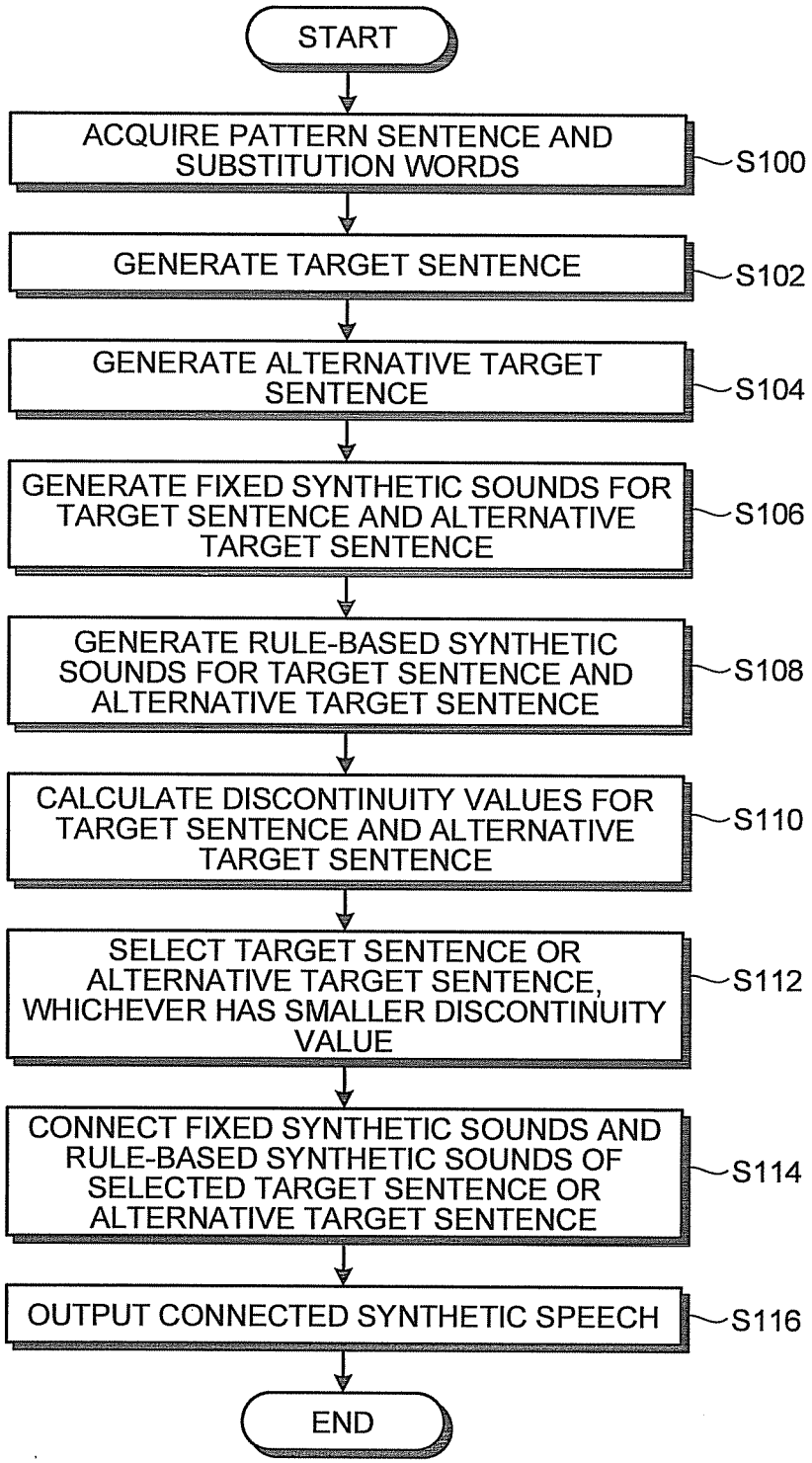
FIG. 14 is a flowchart showing an example procedure of a speech synthesizing process performed by the speech synthesizing device according to the second embodiment.

At Step S100 shown in FIG. 14, the acquiring unit 1040 acquires a pattern sentence and substitution words input by the input unit 10.

At Step S102, the target-sentence generating unit 1045 replaces the non-fixed segments of the pattern sentence acquired by the acquiring unit 1040 with the substitution words acquired by the acquiring unit 1040 in order to generate a target sentence.

At Step S104, the alternative target-sentence generating unit 1046 generates an alternative target sentence having a similarity higher than the threshold with regard to the target sentence generated by the target-sentence generating unit 1045.

At Step S106, the fixed synthetic-sound generating unit 1050 generates, by use of the speech data stored in the speech storage unit 32, fixed synthetic sounds for the target sentence generated by the target-sentence generating unit 1045 and the alternative target sentence generated by the alternative target-sentence generating unit 1046.

At Step S108, the rule-based synthetic-sound generating unit 1055 generates rule-based synthetic sounds for the target sentence generated by the target-sentence generating unit 1045 and the alternative target sentence generated by the alternative target-sentence generating unit 1046, by referring to the dictionary data stored in the dictionary storage unit 34.

At Step S110, the calculating unit 1060 calculates the discontinuity value of the boundary between the fixed synthetic sounds generated by the fixed synthetic-sound generating unit 1050 and the rule-based synthetic sounds generated by the rule-based synthetic-sound generating unit 1055, for the target sentence generated by the target-sentence generating unit 1045 and the alternative target sentence generated by the alternative target-sentence generating unit 1046.

At Step S112, the selecting unit 1065 selects either the target sentence generated by the target-sentence generating unit 1045 or the alternative target sentence generated by the alternative target-sentence generating unit 1046, whichever has the smaller discontinuity value calculated by the calculating unit 1060.

At Step S114, the connecting unit 1070 connects the fixed synthetic sounds and the rule-based synthetic sounds of the target sentence or the alternative target sentence, whichever is selected by the selecting unit 1065.

The process of Step S116 is the same as that of Step S24 in the flowchart of FIG. 7, and the explanation thereof is omitted.

As described above, according to the second embodiment, a target sentence and an alternative target sentence that is semantically equivalent to the target sentence are generated from a single pattern sentence; the generated target sentence or alternative target sentence, whichever has the smaller discontinuity value for the connection boundary between the fixed synthetic sounds and the rule-based synthetic sounds, is selected; and a synthetic speech is output by connecting the fixed synthetic sounds and the rule-based synthetic sounds of the selected sentence.

According to the second embodiment, the user does not have to prepare a plurality of pattern sentences that are semantically equal to one another in advance, and an alternative target sentence that is semantically equivalent to the target sentence can be automatically generated. Then, the target sentence or the alternative target sentence, whichever has the smaller discontinuity value, is selected to output a synthetic speech. Therefore, the synthetic speech with less unnaturalness, which is accompanied by connecting synthetic sounds, can be generated, while lightening the workload on the development.

The above-described speech synthesizing devices 1 and 1001 according to the embodiments have a hardware structure utilizing an ordinary computer and include a controlling device such as a CPU, memory devices such as a read only memory (ROM) and a RAM, external memory devices such as an HDD, an SSD, and a removable drive device, a speech output device such as a speaker, and input devices such as a keyboard and a mouse.

A speech synthesizing program executed by the speech synthesizing devices 1 and 1001 according to the embodiments is stored in a file of an installable or executable format, in a computer-readable memory medium such as a CD-ROM, a flexible disk (FD), a CD-R, and a digital versatile disk (DVD), and is provided as a computer program product.

Furthermore, the speech synthesizing program executed by the speech synthesizing devices 1 and 1001 according to the embodiments may be stored in a ROM or the like to be provided.

The speech synthesizing program executed by the speech synthesizing devices 1 and 1001 according to the embodiments has a module configuration containing the above-described units (the acquiring unit, the sentence generating unit, the fixed synthetic-sound generating unit, the rule-based synthetic-sound generating unit, the calculating unit, the selecting unit, the connecting unit, the output controlling unit, and the like). As the actual hardware configuration, the CPU (processor) reads and executes the speech synthesizing program from the memory medium so that the units are loaded onto the main storage device, where the acquiring unit, the sentence generating unit, the fixed synthetic-sound generating unit, the rule-based synthetic-sound generating unit, the calculating unit, the selecting unit, the connecting unit, the output controlling unit, and the like are implemented on the main storage device.

The present invention is not limited to the above embodiments. In the implementation, the invention can be modified and embodied without departing the scope of the invention. Furthermore, the structural components disclosed in the embodiments can be suitably combined to offer various inventions. For example, some of the structural components may be eliminated from the structure indicated in any of the embodiments. The structural components of different embodiments may be suitably combined.

The naturalness tends to be lost when the time change of the spectrum representing the acoustic characteristics is discontinuous at the connection boundary. For this reason, when calculating the discontinuity value, the calculating units 60 and 1060 according to the embodiments may take into account, as a spectrum distortion, the sum of the spectrum distances that represent the degrees of discontinuity for the spectrum parameters.

In addition, the naturalness also tends to be lost when the time change of the fundamental frequencies representing intonations is discontinuous at the connection boundary. Thus, the calculating units 60 and 1060 according to the embodiments may take into account, as a fundamental frequency distortion, the sum of the fundamental frequency distances representing the discontinuity of the fundamental frequencies when calculating the discontinuity value.

In a rule-based sound synthesizing method, less-frequently co-occurring phonemes that are generated in accordance with rules tend to sound less natural than more-frequently co-occurring phonemes. The calculating units 60 and 1060 according to the embodiments therefore may take into account the inverse of the phonological co-occurrence probability as a phonological co-occurrence distortion when calculating the discontinuity value.

In addition, the naturalness tends to be lost when the same target sentence is repeatedly used. Thus, the calculating units 60 and 1060 according to the embodiments may assign weights to the calculated discontinuity values depending on the frequency of the target sentence selected by the selecting units 65 and 1065, and calculate a new discontinuity value taking into account the calculated discontinuity values to which the weights are assigned. This would prevent any target sentence that is frequently used in the past from being repeatedly used. As an example of calculated and weight-assigned discontinuity value, the calculated discontinuity value of the target sentence multiplied by the frequency of selection of the target sentence may be adopted.

With this arrangement, the synthetic speech of the same target sentence would not be repeatedly output, but different target sentences that are semantically equivalent are output. Hence, speech synthesis that is suitable for an interface of a human-like machine such as a robot can be realized.

In the above explanation of the present embodiments, pattern sentences and substitution words that are to be acquired are input by the input unit 10. Alternatively, the pattern sentences and substitution words may be pre-stored in the storage unit 30 so that the acquiring units 40 and 1040 can acquire the pattern sentences and the substitution words from the storage unit 30.

In the explanation of the second embodiment, a target sentence and an alternative target sentence are generated from a single pattern sentence. However, a plurality of target sentences and alternative target sentences may be generated from multiple pattern sentences in the second embodiment.

In the explanation of the second embodiment, an alternative target sentence is generated by changing the word order of the pattern sentence and then replacing the non-fixed segments with the substitution words. An alternative target sentence may be generated by first generating a target sentence by replacing the non-fixed segments of the pattern sentence with the substitution words and then changing the word order of the target sentence.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech synthesizing device comprising:

an acquiring unit configured to acquire a plurality of pattern sentences, which are semantically equivalent to one another and each include a fixed segment and a non-fixed segment, and a substitution word, the fixed segment is not to be replaced with any other word, the non-fixed segment is to be replaced with another word, the substitution word is substituted for the non-fixed segment;

a sentence generating unit configured to generate a plurality of target sentences by replacing the non-fixed segment with the substitution word for each of the pattern sentences;

a first synthetic-sound generating unit configured to generate a first synthetic sound, which is a synthetic sound of the fixed segment, for each of the target sentences;

a second synthetic-sound generating unit configured to generate a second synthetic sound, which is a synthetic sound of the substitution word, for each of the target sentences;

a calculating unit configured to calculate a discontinuity value of a boundary between the first synthetic sound and the second synthetic sound, for each of the target sentences;

a selecting unit configured to select one of the target sentences having the smallest discontinuity value from the target sentences; and a connecting unit configured to connect the first synthetic sound and the second synthetic sound of the target sentence selected.

2. The device according to claim 1, wherein the calculating unit calculates the discontinuity value taking into account at least one of a spectrum distortion, a fundamental frequency distortion, and a phonological co-occurrence distortion at the boundary between the first synthetic sound and the second synthetic sound.

3. The device according to claim 1, wherein the calculating unit calculates the discontinuity value taking into account a weight-assigned discontinuity value that is generated by assigning a weight to a calculated discontinuity value depending on a frequency with which the selecting unit selects the target sentence.

4. A speech synthesizing device comprising:

an acquiring unit configured to acquire a pattern sentence, which includes a fixed segment that is not to be replaced with any other word and a non-fixed segment that is to be replaced with another word, and a substitution word that is substituted for the non-fixed segment;

a first sentence generating unit configured to generate a target sentence by replacing the non-fixed segment with the substitution word;

a second sentence generating unit configured to generate an alternative target sentence that has a similarity value to the target sentence that exceeds a threshold;

a first synthetic-sound generating unit configured to generate a first synthetic sound, which is a synthetic sound of the fixed segment, for the target sentence and the alternative target sentence;

a second synthetic-sound generating unit configured to generate a second synthetic sound, which is a synthetic sound of the substitution word, for the target sentence and the alternative target sentence;

a calculating unit configured to calculate a discontinuity value of a boundary between the first synthetic sound and the second synthetic sound, for the target sentence and the alternative target sentence;

a selecting unit configured to select the target sentence or the alternative target sentence, whichever has the smaller discontinuity value; and a connecting unit configured to connect the first synthetic sound and the second synthetic sound of the target sentence or the alternative target sentence that is selected.

5. The device according to claim 4, wherein the second sentence generating unit generates the alternative target sentence by performing at least one of operations of changing a word order of the pattern sentence, replacing a word of the pattern sentence with a synonym, and replacing a phrase of the pattern sentence with a different phrase, in addition to replacing the non-fixed segment with the substitution word.

6. A computer program product having a computer readable non-transitory medium including programmed instructions for synthesizing a speech that, when executed by a computer, causes the computer to perform:

acquiring a plurality of pattern sentences, which are semantically equivalent to one another and each include a fixed segment and a non-fixed segment, and a substitution word, the fixed segment is not to be replaced with any other word, the non-fixed segment is to be replaced with another word, the substitution word is substituted for the non-fixed segment; and a substitution word that is substituted for the non-fixed segment;

generating a plurality of target sentences by replacing the non-fixed segment with the substitution word for each of the pattern sentences;

generating a first synthetic sound, which is a synthetic sound of the fixed segment, for each of the target sentences;

generating a second synthetic sound, which is a synthetic sound of the substitution word, for each of the target sentences;

calculating a discontinuity value of a boundary between the first synthetic sound and the second synthetic sound, for each of the target sentences;

selecting one of the target sentences having the smallest discontinuity value from the target sentences; and connecting the first synthetic sound and the second synthetic sound of the target sentence selected.

7. A computer program product having a computer readable non-transitory medium including programmed instructions for synthesizing a speech that, when executed by a computer, causes the computer to perform:

acquiring a pattern sentence, which includes a fixed segment that is not to be replaced with any other word and a non-fixed segment that is to be replaced with another word, and a substitution word that is to be substituted for the non-fixed segment;

acquiring a pattern sentence, which includes a fixed segment that is not to be replaced with any other word and a non-fixed segment that is to be replaced with another word, and a substitution word that is to be substituted for the non-fixed segment;

generating a target sentence by replacing the non-fixed segment with the substitution word;

generating an alternative target sentence having a higher similarity value to the target sentence that exceeds a threshold;

generating a first synthetic sound, which is a synthetic sound of the fixed segment, for the target sentence and the alternative target sentence;

generating a second synthetic sound, which is a synthetic sound of the substitution word, for the target sentence and the alternative target sentence;

calculating a discontinuity value of a boundary between the first synthetic sound and the second synthetic sound, for the target sentence and the alternative target sentence;

selecting the target sentence or the alternative target sentence, whichever has the smaller discontinuity value; and connecting the first synthetic sound and the second synthetic sound of the target sentence or the alternative target sentence that is selected.

8. A speech synthesizing method comprising:

acquiring a plurality of pattern sentences, which are semantically equivalent to one another and each include a fixed segment and a non-fixed segment, and a substitution word, the fixed segment is not to be replaced with any other word, the non-fixed segment is to be replaced with another word, the substitution word is substituted for the non-fixed segment;

generating a plurality of target sentences by replacing the non-fixed segment with the substitution word for each of the pattern sentences;

generating a first synthetic sound, which is a synthetic sound of the fixed segment, for each of the target sentences;

generating a second synthetic sound, which is a synthetic sound of the substitution word, for each of the target sentences;

calculating a discontinuity value of a boundary between the first synthetic sound and the second synthetic sound, for each of the target sentences;

selecting one of the target sentences having the smallest discontinuity value from the target sentences; and connecting the first synthetic sound and the second synthetic sound of the target sentence selected.

9. A speech synthesizing method comprising:

acquiring a pattern sentence, which includes a fixed segment that is not to be replaced with any other word and a non-fixed segment that is to be replaced with another word, and a substitution word that is to be substituted for the non-fixed segment;

generating a target sentence by replacing the non-fixed segment with the substitution word;

generating an alternative target sentence having a similarity value to the target sentence that exceeds a threshold;

generating a first synthetic sound, which is a synthetic sound of the fixed segment, for the target sentence and the alternative target sentence;

generating a second synthetic sound, which is a synthetic sound of the substitution word, for the target sentence and the alternative target sentence;

calculating a discontinuity value of a boundary between the first synthetic sound and the second synthetic sound, for the target sentence and the alternative target sentence;

selecting the target sentence or the alternative target sentence, whichever has the smaller discontinuity value; and connecting the first synthetic sound and the second synthetic sound of the target sentence or the alternative target sentence that is selected.

* * * * *